US011634827B2

(12) United States Patent
Urgeghe et al.

(10) Patent No.: US 11,634,827 B2
(45) Date of Patent: Apr. 25, 2023

(54) ANODE FOR ELECTROLYTIC EVOLUTION OF CHLORINE

(75) Inventors: Christian Urgeghe, Redecesio-Segrate (IT); Chiara Pezzoni, Cassina de' Pecchi (IT); Antonio Lorenzo Antozzi, Merate (IT)

(73) Assignee: INDUSTRIE DE NORA S.P.A., Milan (IT)

( * ) Notice: Subject to any disclaimer, the term of this patent is extended or adjusted under 35 U.S.C. 154(b) by 147 days.

(21) Appl. No.: 13/877,942

(22) PCT Filed: Nov. 25, 2011

(86) PCT No.: PCT/EP2011/071079

§ 371 (c)(1),
(2), (4) Date: Apr. 5, 2013

(87) PCT Pub. No.: WO2012/069653

PCT Pub. Date: May 31, 2012

(65) Prior Publication Data

US 2013/0186750 A1 Jul. 25, 2013

(30) Foreign Application Priority Data

Nov. 26, 2010 (IT) ..... MI2010A002193

(51) Int. Cl.
*C25B 11/093* (2021.01)

(52) U.S. Cl.
CPC ..... *C25B 11/093* (2021.01)

(58) Field of Classification Search
CPC ... C25B 11/04; C25B 11/0405; C25B 11/041; C25B 11/0426; C25B 11/0431; C25B 11/00–11/097; C25B 1/34–1/46; C25C 7/02
USPC ..... 204/290.01, 290.12, 290.14, 290.03, 204/290.08, 293
See application file for complete search history.

(56) References Cited

U.S. PATENT DOCUMENTS

| | | | | |
|---|---|---|---|---|
| 7,258,778 | B2 * | 8/2007 | Hardee | C25B 11/0478 204/290.01 |
| 2004/0031692 | A1 * | 2/2004 | Hardee | 205/118 |
| 2007/0289865 | A1 * | 12/2007 | DiFranco | C25B 1/26 204/242 |

FOREIGN PATENT DOCUMENTS

| | | | | |
|---|---|---|---|---|
| EP | 0153586 | * | 9/1985 | 204/280 |
| EP | 0437178 | A1 * | 9/1985 | 204/280 |
| EP | 0 479 423 | A1 | 4/1992 | |
| EP | 0479423 | A1 * | 4/1992 | 204/280 |
| EP | 1656471 | B1 * | 12/2009 | C01G 19/08 |
| WO | 2005/033367 | A1 | 4/2005 | |
| WO | 2010/055065 | A1 | 5/2010 | |
| WO | WO 2010055065 | A1 * | 5/2010 | 204/280 |

OTHER PUBLICATIONS

International Search Report issued in International PCT Application No. PCT/EP2011/071079.

* cited by examiner

*Primary Examiner* — Alexander W Keeling
(74) *Attorney, Agent, or Firm* — Lucas & Mercanti, LLP

(57) ABSTRACT

An electrode suitable for chlorine evolution in electrolysis cells consists of a metal substrate coated with two distinct compositions applied in alternate layers, the former comprising oxides of iridium, ruthenium and valve metals, for instance tantalum, and the latter comprising oxides of iridium, ruthenium and tin.
The thus-obtained electrode couples excellent characteristics of anodic potential and selectivity towards the chlorine evolution reaction.

14 Claims, No Drawings

ANODE FOR ELECTROLYTIC EVOLUTION OF CHLORINE

This application is a U.S. national stage of PCT/EP2011/071079 filed on Nov. 25, 2011 which claims the benefit of priority from Italian Patent Application No. MI2010A002193 filed Nov. 26, 2010, the contents of each of which are incorporated herein by reference.

FIELD OF THE INVENTION

The invention relates to an electrode suitable for functioning as anode in electrolysis cells, for instance as anode for chlorine evolution in chlor-alkali cells.

BACKGROUND OF THE INVENTION

The electrolysis of alkali chloride brines, for instance of sodium chloride brine for production of chlorine and caustic soda, can be carried out with titanium or other valve metal-based anodes activated with a superficial layer of ruthenium dioxide ($RuO_2$), which has the property of decreasing the overvoltage of chlorine evolution anodic reaction. A typical catalyst formulation for chlorine evolution for instance consists of a mixture of $RuO_2$ and $TiO_2$, with optional addition of $IrO_2$, characterised by a quite reduced, although non optimal, chlorine evolution anodic overvoltage. A partial improvement in terms of chlorine overvoltage and thus of overall process voltage and energy consumption can be obtained by adding a certain amount of a second noble metal selected between iridium and platinum to a formulation based on $RuO_2$ mixed with $SnO_2$, for instance as disclosed in EP 0 153 586; this and other formulations containing tin nevertheless present the problem of simultaneously decreasing also the overvoltage of the concurrent oxygen evolution reaction, so that chlorine produced by the anodic reaction is contaminated by an excessive amount of oxygen. The negative effect of oxygen contamination, which implies risks for the chlorine liquefaction phase preventing its use in some important applications in the field of polymer industry, is only partially mitigated by the formulation disclosed in WO 2005/014885, which provides an addition of critical amounts of palladium and niobium. Especially at high current density, indicatively above 3 $kA/m^2$, the purity level of product chlorine is still far from the minimum target set by industry.

It is therefore necessary to identify a catalyst formulation for an electrode suitable for functioning as chlorine-evolving anode in industrial electrolysis cells presenting characteristics of improved anodic potential in chlorine evolution jointly with an adequate purity of product chlorine.

SUMMARY OF THE INVENTION

Various aspects of the invention are set out in the accompanying claims.

Under a first aspect, the invention relates to an electrode for evolution of gaseous products in electrolytic cells, for instance for chlorine evolution in alkali brine electrolysis cells, consisting of a metal substrate coated with two distinct catalytic compositions applied in alternating layers, the first catalytic composition comprising a mixture of oxides of iridium, of ruthenium and of at least one valve metal and being free of tin, the second catalytic composition comprising a mixture of oxides of iridium, of ruthenium and of tin. By application in alternating layers it is intended in the present context that in one embodiment the electrode can comprise two overlaid catalytic layers, each of which deposited in one or more coats, the innermost of which, directly contacting the substrate, corresponds to one of the two catalytic compositions, for instance the first one, and the outermost of which corresponds to the other catalytic composition; or, in an alternative embodiment, the electrode can comprise a higher number of overlaid catalytic layers, alternatingly corresponding to the first and to the second composition. The inventors surprisingly observed that an electrode prepared with an alternation of layers as hereinbefore described presents a remarkably reduced chlorine overvoltage, typical of the best tin-containing catalytic layers, without however such a reduction in oxygen overvoltage so as to contaminate the product chlorine as it would be reasonably expected.

In one embodiment, the valve metal of the first catalytic composition is titanium; although during the testing phase excellent results were observed also with different valve metals in the first catalytic composition such as tantalum, niobium and zirconium, it was observed that titanium allows to combine an excellent catalytic activity and selectivity in a wider compositional range (indicatively 20 to 80% as atomic composition referred to the metals). In one embodiment, the first catalytic composition comprises oxides of iridium, ruthenium and titanium in a Ru=10-40%, Ir=5-25%, Ti=35-80% atomic percentage referred to the metals. Optionally, the first catalytic composition can be added with a small amount of platinum, in a 0.1 to 5% atomic percentage referred to the metals; this can have the advantage of further reducing the chlorine evolution reaction overvoltage, although at a slightly higher cost.

In one embodiment, the second catalytic composition comprises oxides of iridium, of ruthenium and of tin in a Ru=20-60%, Ir=1-20%, Sn=35-65% atomic percentage referred to the metals. Optionally, the second catalytic composition can be added with an amount of platinum and/or palladium in an overall 0.1-10% atomic percentage referred to the metals; the second catalytic composition can be also added with an amount of niobium or tantalum in a 0.1-3% atomic percentage referred to the metals. Such optional additions can have the advantage of increasing the operative lifetime of the electrode and allow obtaining a more favourable balance of catalytic activity versus selectivity referred to the chlorine evolution reaction.

Under another aspect, the invention relates to a method of manufacturing an electrode comprising the following sequential steps:

- application of a first solution containing precursors, for instance thermally decomposable salts, of the components of the first catalytic composition, with subsequent optional drying at 50-200° C. for 5-60 minutes and thermal decomposition at 400-850° C. for a time not lower than 3 minutes in the presence of air; the application may be effected in multiple coats, that is repeating the above passages more times
- application of a second solution containing precursors, for instance thermally decomposable salts, of the components of the second catalytic composition, with subsequent optional drying at 50-200° C. for 5-60 minutes and thermal decomposition at 400-850° C. for a time not lower than 3 minutes in the presence of air; also in this case the application may be effected in multiple coats, that is repeating the above passages more times
- optional repetition of the application, optional drying and thermal decomposition of the first solution only or of both solutions sequentially, with optional repetition of the whole cycle.

The execution of the first two steps may be reversed, by applying first the solution containing the precursors of the second, tin-containing catalytic composition.

Under a further aspect, the invention relates to an electrolysis cell of alkali chloride solutions, for instance an electrolysis cell of sodium chloride brine for production of chlorine and caustic soda, which carries out the anodic evolution of chlorine on an electrode as hereinbefore described.

The following examples are included to demonstrate particular embodiments of the invention, whose practicability has been largely verified in the claimed range of values. It should be appreciated by those of skill in the art that the compositions and techniques disclosed in the examples which follow represent compositions and techniques discovered by the inventors to function well in the practice of the invention; however, those of skill in the art should, in light of the present disclosure, appreciate that many changes can be made in the specific embodiments which are disclosed and still obtain a like or similar result without departing from the scope of the invention.

EXAMPLE 1

A piece of titanium mesh of 10 cm×10 cm size was blasted with corundum, cleaning the residues with a compressed air jet. The piece was then degreased using acetone in an ultrasonic bath for about 10 minutes. After drying, the piece was dipped in an aqueous solution containing 250 g/l of NaOH and 50 g/l of $KNO_3$ at about 100° c for approximately 1 hour. After the alkaline treatment, the piece was rinsed three times in deionised water at 60° C., changing the liquid each time. The last rinse was carried out adding a small amount of HCl (about 1 ml per litre of solution). An air drying was then effected and the appearance of a brown hue, due to the growth of a thin $TiO_x$ film, was observed.

100 ml of a first hydroalcoholic solution, containing $RuCl_3*3H_2O$, $H_2IrCl_6*6H_2O$, $TiCl_3$ in a water and 2-propanol mixture acidified with HCl, having a molar composition of 30% Ru, 20% Ir, 50% Ti referred to the metals were prepared.

100 ml of a second hydroalcoholic solution containing $RuCl_3*3H_2O$, $H_2IrCl_6*6H_2O$, $NbCl_5$, $PdCl_2$ and tin hydroxyacetochloride obtained in accordance with the procedure disclosed in Example 3 of WO 2005/014885, in a water and ethanol mixture acidified with HCl, having a molar composition of 20% Ru, 10% Ir, 10% Pd, 59% Sn, 1% Nb referred to the metals were also prepared.

The first solution was applied to the titanium mesh piece by brushing in three coats; after each coat, a drying at 100-110° C. for about 10 minutes was carried out, followed by a thermal treatment of 15 minutes at 450° C. The piece was cooled on air each time before applying the subsequent coat.

The second solution was then applied to the titanium mesh by brushing in three coats, drying and final thermal treatment as for the first solution.

At the end of the whole procedure, an overall noble metal loading of 9 g/m$^2$ was achieved, expressed as the sum of Ru, Ir and Pd referred to the metals.

The thus obtained electrode was identified as sample #1.

EXAMPLE 2

A piece of titanium mesh of 10 cm×10 cm size was blasted with corundum, cleaning the residues with a compressed air jet. The piece was then degreased using acetone in an ultrasonic bath for about 10 minutes. After drying, the piece was dipped in an aqueous solution containing 250 g/l of NaOH and 50 g/l of $KNO_3$ at about 100° c for approximately 1 hour. After the alkaline treatment, the piece was rinsed three times in deionised water at 60° C., changing the liquid each time. The last rinse was carried out adding a small amount of HCl (about 1 ml per litre of solution). An air drying was then effected and the appearance of a brown hue, due to the growth of a thin $TiO_x$ film, was observed.

100 ml of a first hydroalcoholic solution, containing $RuCl_3*3H_2O$, $H_2IrCl_6*6H_2O$, Ti(III) ortho-butyl titanate, $H_2PtCl_6$ in a water and 2-propanol mixture acidified with HCl, having a molar composition of 16.5% Ru, 9% Ir, 1.5% Pt, 73% Ti referred to the metals were then prepared. 100 ml of a second hydroalcoholic solution as that of example 1 were also prepared.

The first solution was applied to the titanium mesh piece by brushing in three coats; after each coat, a drying at 100-110° C. for about 10 minutes was carried out, followed by a thermal treatment of 15 minutes at 450° C. The piece was cooled on air each time before applying the subsequent coat.

The second solution was then applied to the titanium mesh by brushing in three coats, drying and final thermal treatment as for the first solution.

At the end of the whole procedure, an overall noble metal loading of 9 g/m$^2$ was achieved, expressed as the sum of Ru, Ir and Pt referred to the metals.

The thus obtained electrode was identified as sample #2.

EXAMPLE 3

A piece of titanium mesh of 10 cm×10 cm size was blasted with corundum, cleaning the residues with a compressed air jet. The piece was then degreased using acetone in an ultrasonic bath for about 10 minutes. After drying, the piece was dipped in an aqueous solution containing 250 g/l of NaOH and 50 g/l of $KNO_3$ at about 100° c for approximately 1 hour. After the alkaline treatment, the piece was rinsed three times in deionised water at 60° C., changing the liquid each time. The last rinse was carried out adding a small amount of HCl (about 1 ml per litre of solution). An air drying was then effected and the appearance of a brown hue, due to the growth of a thin $TiO_x$ film, was observed.

100 ml of a first hydroalcoholic solution, containing $RuCl_3*3H_2O$, $H_2IrCl_6*6H_2O$, $TiOCl_2$ in a water and 1-butanol mixture acidified with HCl, having a molar composition of 17% Ru, 10% Ir, 73% Ti referred to the metals were then prepared.

100 ml of a second hydroalcoholic solution containing $RuCl_3*3H_2O$, $H_2IrCl_6*6H_2O$, $NbCl_5$, $H_2PtCl_6$ and tin hydroxyacetochloride obtained in accordance with the procedure disclosed in Example 3 of WO 2005/014885, in a water and ethanol mixture acidified with acetic acid, having a molar composition of 30% Ru, 3% Ir, 5% Pt, 59% Sn, 3% Nb referred to the metals were also prepared.

The first solution was applied to the titanium mesh piece by brushing in three coats; after each coat, a drying at 100-110° C. for about 10 minutes was carried out, followed by a thermal treatment of 15 minutes at 450° C. The piece was cooled on air each time before applying the subsequent coat.

The second solution was then applied to the titanium mesh by brushing in three coats, drying and final thermal treatment as for the first solution.

At the end of the whole procedure, an overall noble metal loading of 9 g/m$^2$ was achieved, expressed as the sum of Ru, Ir and Pt referred to the metals.

The thus obtained electrode was identified as sample #3.

EXAMPLE 4

A piece of titanium mesh of 10 cm×10 cm size was blasted with corundum, cleaning the residues with a compressed air jet. The piece was then degreased using acetone in an ultrasonic bath for about 10 minutes. After drying, the piece was dipped in an aqueous solution containing 250 g/l of NaOH and 50 g/l of $KNO_3$ at about 100° c for approximately 1 hour. After the alkaline treatment, the piece was rinsed three times in deionised water at 60° C., changing the liquid each time. The last rinse was carried out adding a small amount of HCl (about 1 ml per litre of solution). An air drying was then effected and the appearance of a brown hue, due to the growth of a thin $TiO_x$ film, was observed.

100 ml of a first hydroalcoholic solution, containing $RuCl_3$*$3H_2O$, $H_2IrCl_6$*$6H_2O$, $H_2PtCl_6$ and $TiCl_3$ in a water and 2-propanol mixture acidified with HCl, having a molar composition of 16.5% Ru, 9% Ir, 1.5% Pt, 73% Ti referred to the metals were then prepared.

100 ml of a second hydroalcoholic solution containing $RuCl_3$*$3H_2O$, $H_2IrCl_6$*$6H_2O$, $NbCl_5$, $H_2PtCl_6$ and tin hydroxyacetochloride obtained in accordance with the procedure disclosed in Example 3 of WO 2005/014885, in a water and 2-propanol mixture acidified with acetic acid, having a molar composition of 30% Ru, 3% Ir, 5% Pt, 59% Sn, 3% Nb referred to the metals were also prepared.

The first solution was applied to the titanium mesh piece by brushing in two coats; after each coat, a drying at 100-110° C. for about 10 minutes was carried out, followed by a thermal treatment of 15 minutes at 450° C. The piece was cooled on air each time before applying the subsequent coat.

The second solution was then applied to the titanium mesh by brushing in three coats, drying and final thermal treatment as for the first solution.

Finally, the first solution was again applied by brushing in two coats, drying and final thermal treatment as above.

At the end of the whole procedure, an overall noble metal loading of 9 g/m$^2$ was achieved, expressed as the sum of Ru, Ir and Pt referred to the metals.

The thus obtained electrode was identified as sample #4.

COUNTEREXAMPLE 1

A piece of titanium mesh of 10 cm×10 cm size was blasted with corundum, cleaning the residues with a compressed air jet. The piece was then degreased using acetone in an ultrasonic bath for about 10 minutes. After drying, the piece was dipped in an aqueous solution containing 250 g/l of NaOH and 50 g/l of $KNO_3$ at about 100° c for approximately 1 hour. After the alkaline treatment, the piece was rinsed three times in deionised water at 60° C., changing the liquid each time. The last rinse was carried out adding a small amount of HCl (about 1 ml per litre of solution). An air drying was then effected and the appearance of a brown hue, due to the growth of a thin $TiO_x$ film, was observed.

100 ml of a first hydroalcoholic solution, containing $RuCl_3$*$3H_2O$, $H_2IrCl_6$*$6H_2O$, $TiCl_3$ in a water and 2-propanol mixture acidified with HCl, having a molar composition of 30% Ru, 20% Ir, 50% Ti referred to the metals were prepared.

The solution was applied to the titanium mesh piece by brushing in five coats; after each coat, a drying at 100-110° C. for about 10 minutes was carried out, followed by a thermal treatment of 15 minutes at 450° C. The piece was cooled on air each time before applying the subsequent coat. At the end of the whole procedure, an overall noble metal loading of 9 g/m$^2$ was achieved, expressed as the sum of Ru and Ir referred to the metals.

The thus obtained electrode was identified as sample #C1.

COUNTEREXAMPLE 2

A piece of titanium mesh of 10 cm×10 cm size was blasted with corundum, cleaning the residues with a compressed air jet. The piece was then degreased using acetone in an ultrasonic bath for about 10 minutes. After drying, the piece was dipped in an aqueous solution containing 250 g/l of NaOH and 50 g/l of $KNO_3$ at about 100° c for approximately 1 hour. After the alkaline treatment, the piece was rinsed three times in deionised water at 60° C., changing the liquid each time. The last rinse was carried out adding a small amount of HCl (about 1 ml per litre of solution). An air drying was then effected and the appearance of a brown hue, due to the growth of a thin $TiO_x$ film, was observed.

100 ml of a hydroalcoholic solution containing $RuCl_3$*$3H_2O$, $H_2IrCl_6$*$H_2O$, $NbCl_5$, $H_2PtCl_6$ and tin hydroxyacetochloride obtained in accordance with the procedure disclosed in Example 3 of WO 2005/014885, in a water and 2-propanol mixture acidified with acetic acid, having a molar composition of 30% Ru, 3% Ir, 5% Pt, 59% Sn, 3% Nb referred to the metals were prepared. The solution was applied to the titanium mesh piece by brushing in five coats; after each coat, a drying at 100-110° C. for about 10 minutes was carried out, followed by a thermal treatment of 15 minutes at 450° C. The piece was cooled on air each time before applying the subsequent coat. At the end of the whole procedure, an overall noble metal loading of 9 g/m$^2$ was achieved, expressed as the sum of Ru, Ir and Pt referred to the metals.

The thus obtained electrode was identified as sample #C2.

EXAMPLE 5

The samples of the previous examples were characterised as anodes for chlorine evolution in a lab cell fed with a sodium chloride brine at 200 g/l concentration, strictly controlling the pH at 3. Table 1 reports chlorine overvoltage measured at a current density of 4 kA/m$^2$ and the volume percentage of oxygen in product chlorine.

TABLE 1

| Sample ID | $\eta Cl_2$ (mV) | $O_2$ (%) |
|---|---|---|
| 1 | 50 | 0.25 |
| 2 | 50 | 0.18 |
| 3 | 49 | 0.20 |
| 4 | 47 | 0.17 |
| C1 | 72 | 0.25 |
| C2 | 53 | 0.80 |

The previous description is not intended to limit the invention, which may be used according to different embodiments without departing from the scopes thereof, and whose extent is univocally defined by the appended claims.

Throughout the description and claims of the present application, the term "comprise" and variations thereof such as "comprising" and "comprises" are not intended to exclude the presence of other elements or additives.

The discussion of documents, acts, materials, devices, articles and the like is included in this specification solely for the purpose of providing a context for the present invention. It is not suggested or represented that any or all of these matters formed part of the prior art base or were common general knowledge in the field relevant to the present invention before the priority date of each claim of this application.

We claim:

1. An electrode for evolution of gaseous products in electrolytic cells consisting of a metal substrate coated with a plurality of alternating layers of at least one first catalytic composition and at least a second catalytic composition, said first catalytic composition comprises a mixture of oxides of iridium, of ruthenium and of at least one valve metal and being free of tin, said second catalytic composition comprises a mixture of oxides of iridium, of ruthenium, of tin, niobium and at least one noble metal selected from the group consisting of palladium and platinum, wherein the innermost of said plurality of alternating layers corresponds to said first catalytic composition, wherein the electrode reduces chlorine overvoltage without reduction in oxygen overvoltage, wherein said valve metal of said first catalytic composition is titanium and said oxides of iridium, ruthenium and titanium present in said first catalytic composition are Ru=10-30%, Ir=5-25%, Ti=35-80% atomic percentage referred to the metals, and wherein said second catalytic layer is obtained by applying a solution containing precursors of ruthenium, iridium, tin, niobium, and at least one noble metal selection from the group consisting of palladium and platinum, wherein tin is in the form of tin hydroxyacetochloride such that after thermal treatment said oxides of iridium, of ruthenium and of tin present in said second catalytic composition are Ru=20-60%, Ir=1-20%, Sn=35-65%, atomic percentage referred to the metals, wherein Nb and at least Pd or Pt make up the remainder of the composition's atomic proportions.

2. The electrode according to claim 1 wherein in said first catalytic composition platinum is present in a 0.1-5% atomic percentage referred to the metals.

3. The electrode according to claim 1 wherein in said second catalytic composition platinum or palladium is present in an overall 0.1-10% atomic percentage referred to the metals.

4. The electrode according to claim 1 wherein in said second catalytic composition niobium is present in a 0.1-3% atomic percentage referred to the metals.

5. The electrode according to claim 1 wherein the first catalytic composition comprises oxides of Ru, Ir and Ti and are present in said first catalytic composition in a Ru=16-30%, Ir=9-20%, Ti=50-73% atomic percentage referred to the metals.

6. The electrode according to claim 1 wherein in said second catalytic composition oxides of Ru, Ir, Sn, Nb, and Pd or Pt are present in a Ru=20-30%, Ir=1-10%, Sn=59-65%, and Pd=10% or Pt=5% atomic percentage referred to the metals.

7. An electrolysis cell of alkali chloride solutions comprising the electrode of claim 1 as chlorine-evolving anode.

8. An electrode for evolution of gaseous products in electrolytic cells consisting of a metal substrate coated with a plurality of alternating layers of at least one first catalytic composition and at least a second catalytic composition, said first catalytic composition comprises a mixture of oxides of iridium, of ruthenium, of platinum and of at least one valve metal and being free of tin, said second catalytic composition comprises a mixture of oxides of iridium, of ruthenium, of tin, niobium and at least one noble metal selected from the group consisting of palladium and platinum, wherein the innermost of said plurality of alternating layers corresponds to said first catalytic composition, wherein the electrode reduces chlorine overvoltage without reduction in oxygen overvoltage, wherein said valve metal of said first catalytic composition is titanium and said oxides of iridium, ruthenium, platinum, and titanium present in said first catalytic composition are Ru=10-30%, Ir=5-25%, Ti=35-80% atomic percentage referred to the metals, wherein Pt makes up the remainder of the composition's atomic proportions. and wherein said second catalytic layer is obtained by applying a solution containing precursors of ruthenium, iridium, tin, niobium, and at least one noble metal selection from the group consisting of palladium and platinum, wherein tin is in the form of tin hydroxyacetochloride such that after thermal treatment said oxides of iridium, of ruthenium and of tin present in said second catalytic composition are Ru=20-60%, Ir=1-20%, Sn=35-65%, atomic percentage referred to the metals, wherein Nb and at least Pd or Pt make up the remainder of the composition's atomic proportions.

9. The electrode according to claim 8 wherein in said first catalytic composition platinum is present in a 0.1-5% atomic percentage referred to the metals.

10. The electrode according to claim 8 wherein in said second catalytic composition platinum or palladium is present in an overall 0.1-10% atomic percentage referred to the metals.

11. The electrode according to claim 8 wherein in said second catalytic composition niobium is present in a 0.1-3% atomic percentage referred to the metals.

12. A method for manufacturing the electrode according to claim 1 comprising the execution of the following sequential steps on a metal substrate:

a. applying a first solution containing the precursors of the components of said first catalytic composition;

b. optionally drying at 50-200° C. for a time of 5 to 60 minutes;

c. decomposing said first solution by thermal treatment at 400-850° C. for a time not lower than 3 minutes in the presence of air;

d. applying a second solution containing the precursors of the components of said second catalytic composition;

e. optionally drying at 50-200° C. for a time of 5 to 60 minutes;

f. decomposing said second solution by thermal treatment at 400-850° C. for a time not lower than 3 minutes in the presence of air; and g. optionally repeating steps a-c or the whole sequence of steps a-f once or more times.

13. The method according to claim 12 wherein the sequence consisting of steps a-c and the sequence consisting of steps d-f are reversed.

14. The method according to claim 12 wherein the sequence consisting of steps a-c is repeated more than once before step d, and the sequence of steps d-f is repeated more than once before step g.

* * * * *